US009031243B2

(12) United States Patent
LeBoeuf et al.

(10) Patent No.: US 9,031,243 B2
(45) Date of Patent: May 12, 2015

(54) AUTOMATIC LABELING AND CONTROL OF AUDIO ALGORITHMS BY AUDIO RECOGNITION

(75) Inventors: Jay LeBoeuf, San Francisco, CA (US); Stephen Pope, San Francisco, CA (US)

(73) Assignee: iZotope, Inc., Cambridge, MA (US)

( * ) Notice: Subject to any disclaimer, the term of this patent is extended or adjusted under 35 U.S.C. 154(b) by 376 days.

(21) Appl. No.: 12/892,843

(22) Filed: Sep. 28, 2010

(65) Prior Publication Data

US 2011/0075851 A1 Mar. 31, 2011

Related U.S. Application Data

(60) Provisional application No. 61/246,283, filed on Sep. 28, 2009, provisional application No. 61/249,575, filed on Oct. 7, 2009.

(51) Int. Cl.
*H04R 29/00* (2006.01)

(52) U.S. Cl.
CPC ..... *H04R 29/00* (2013.01)

(58) Field of Classification Search
USPC ..... 700/94; 709/217, 213
See application file for complete search history.

(56) References Cited

U.S. PATENT DOCUMENTS

| | | | | |
|---|---|---|---|---|
| 6,243,674 | B1 * | 6/2001 | Yu | 704/221 |
| 6,826,526 | B1 * | 11/2004 | Norimatsu et al. | 704/222 |
| 6,895,051 | B2 * | 5/2005 | Nieweglowski et al. | 375/240.03 |
| 7,203,669 | B2 * | 4/2007 | Lienhart et al. | 706/48 |
| 7,356,188 | B2 * | 4/2008 | Venkatesan et al. | 382/229 |
| 7,457,749 | B2 * | 11/2008 | Burges et al. | 704/243 |
| 7,533,069 | B2 * | 5/2009 | Fairweather | 706/12 |
| 7,825,321 | B2 * | 11/2010 | Bloom et al. | 84/622 |
| 7,838,755 | B2 * | 11/2010 | Taub et al. | 84/609 |
| 8,175,376 | B2 * | 5/2012 | Marchesotti et al. | 382/159 |
| 8,249,872 | B2 * | 8/2012 | Aronowitz et al. | 704/246 |
| 2005/0021659 | A1 * | 1/2005 | Pilu et al. | 709/213 |
| 2007/0250901 | A1 * | 10/2007 | McIntire et al. | 725/146 |
| 2009/0138263 | A1 * | 5/2009 | Shozakai et al. | 704/243 |

OTHER PUBLICATIONS

T. Lambrou et al., Classification of audio signals using statistical features on time and wavelet transform domains., 1998, IEEE (0/7803-4428-6/98).*

G. Menier and G. Lorette, Lexical analizer based on a self-organizing feature map., 1997, IEEE (0/8186-7898-4/97).*

* cited by examiner

*Primary Examiner* — Duc Nguyen
*Assistant Examiner* — Phan Le
(74) *Attorney, Agent, or Firm* — David Lowry

(57) ABSTRACT

Controlling a multimedia software application using high-level metadata features and symbolic object labels derived from an audio source, wherein a first-pass of low-level signal analysis is performed, followed by a stage of statistical and perceptual processing, followed by a symbolic machine-learning or data-mining processing component is disclosed. This multi-stage analysis system delivers high-level metadata features, sound object identifiers, stream labels or other symbolic metadata to the application scripts or programs, which use the data to configure processing chains, or map it to other media. Embodiments of the invention can be incorporated into multimedia content players, musical instruments, recording studio equipment, installed and live sound equipment, broadcast equipment, metadata-generation applications, software-as-a-service applications, search engines, and mobile devices.

31 Claims, 3 Drawing Sheets

AUTOMATIC LABELING AND CONTROL OF AUDIO ALGORITHMS BY AUDIO RECOGNITION

CROSS-REFERENCE TO RELATED APPLICATIONS

The present application claims the priority benefit of U.S. provisional application No. 61/246,283 filed Sep. 28, 2009 and U.S. provisional application No. 61/249, 575 filed Oct. 7, 2009. The disclosure of each of the aforementioned applications is incorporated herein by reference.

STATEMENT REGARDING FEDERALLY SPONSORED RESEARCH OR DEVELOPMENT

This invention was made with partial government support under IIP-0912981 and IIP-1206435 awarded by the National Science Foundation. The Government may have certain rights in the invention.

BACKGROUND OF THE INVENTION

1. Field of the Invention

The present invention generally concerns real-time audio analysis. More specifically, the present invention concerns machine learning, audio signal processing, and sound object recognition and labeling.

2. Description of the Related Art

Analysis of audio and video data invokes the use of "metadata" that describes different elements of media content. Various fields of production and engineering are becoming increasingly reliant and sophisticated on the use of metadata, including music information retrieval (MIR), audio content identification (finger-printing), automatic (reduced) transcription, summarization (thumb-nailing), source separation (de-mixing), multimedia search engines, media data-mining, and content recommender systems.

In an audio-oriented system using metadata, a source audio signal is typically broken into small "windows" of time (e.g., 10-100 milliseconds in duration). A set of "features" is derived by analyzing the different characteristics of each signal window. The set of raw data-derived features is the "feature vector" for an audio selection. This feature vector can vary from a short single instrument note sample, a two-bar loop, a song, or a complete soundtrack. A raw feature vector typically includes time-domain values (sound amplitude measures) and frequency-domain values (sound spectral content).

The particular set of raw feature vectors derived from any audio analysis may greatly vary from one audio metadata application to another. This variance is often dependent upon, and therefore fixed by, post-processing requirements and the run-time environment of a given application. As the feature vector format and contents in many existing software implementations are fixed, it is difficult to adapt an analysis component for new applications. Furthermore, there are challenges to providing a flexible first-pass feature extractor that can be configured to set up a signal analysis processing phase.

In light of these limitations, some systems perform second-stage "higher-level" feature extraction based on the initial analysis. For example, the second-stage analysis may derive information such as tempo, key, or onset detection as well as feature vector statistics, including derivatives/trajectories, smoothing, running averages, Gaussian mixture models (GMMs), perceptual mapping, bark/sone maps, or result data reduction and pruning. These second-stage analysis functions are generally custom-coded for applications making it equally challenging to develop and configure the second-stage feature vector mapping and reduction processes described above for new applications.

An advanced metadata processing system would add a third stage of numeric/symbolic machine-learning, data-mining, or artificial intelligence modules. Such a processing stage might invoke techniques such as support vector machines (SVMs), artificial neural networks (NNs), clusterers, classifiers, rule-based expert systems, and constraint-satisfaction programming. But while the goal of such a processing operation might be to add symbolic labels to the audio stream, either as a whole (as in determining the instrument name of a single-note audio sample, or the finger-print of a song file), or with time-stamped labels and properties for some manner of events discovered in the stream, it is a challenge to integrate multi-level signal processing tools with symbolic machine-learning-level operations into flexible run-time frameworks for new applications.

Frameworks in the literature generally support only a fixed feature vector and one method of data-mining or application processing. These prior art systems are neither run-time configurable or scriptable nor are they easily integrated with a variety of application run-time environments. Audio metadata systems tend to be narrowly focused on one task or one reasoning component, and there is a challenge to provide configurable media metadata extraction.

There is a need in the art for a flexible and extensible framework that allows developers of multimedia applications or devices to perform signal analysis, object recognition, and labeling of live or stored audio data and map the resulting metadata as control signals or configuration information for a corresponding software or hardware implementation.

SUMMARY OF THE INVENTION

Embodiments of the present invention use multi-stage signal analysis, sound-object recognition, and audio stream labeling to analyze audio signals. The resulting labels and metadata allow software and signal processing algorithms to make content-aware decisions. These automatically-derived decisions or automation allow the performer/engineer to concentrate on the creative audio engineering aspects of live performance, music creation, and recording/mixing rather than organizational file hierarchical duties. Such focus and concentration lends to better-sounding audio, faster and more creative work flows, and lower barriers to entry for novice content creators.

In a first embodiment of the present invention, a method for multi-stage audio signal analysis is claimed. Through the claimed method, three stages of processing take place with respect to an audio signal. In a first stage, windowed signal analysis derives a raw feature vector. A statistical processing operation in the second stage derives a reduced feature vector from the raw feature vector. In a third stage, at least one sound object label that refers to the original audio signal is derived from the reduced feature vector. That sound object label is mapped into a stream of control events, which are sent to a sound-object-driven, multimedia-aware software application. Any of the processing operations of the first through third stages are capable of being configured or scripted.

DETAILED DESCRIPTION

Figure 1:
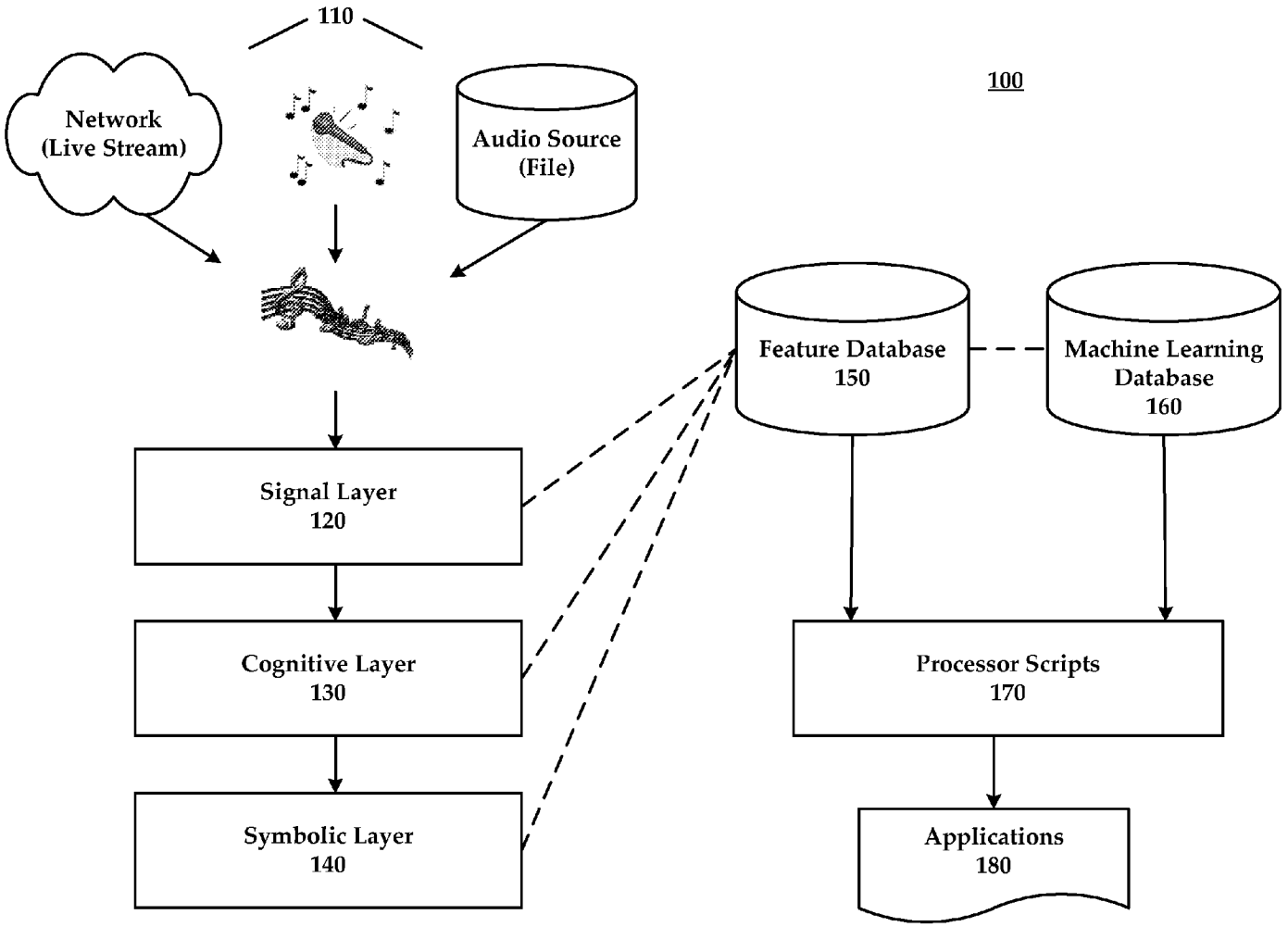
FIG. 1 illustrates the architecture for an audio metadata engine for audio signal processing and metadata mapping.

By using audio signal analysis and machine learning techniques, the type of sound objects presented at the input stage of an audio presentation can be determined in real-time. Sound object types include a male vocalist, female vocalist, snare drum, bass guitar, or guitar feedback. The types of sound objects are not limited to musical instruments, but are inclusive of a classification hierarchy for nearly all natural and artificially created sound—animal sounds, sound effects, medical sounds, auditory environments, and background noises, for example. Sound object recognition may include a single label or a ratio of numerous labels.

A real-time sound object recognition module is executed to "listen" to an input audio signal, add "labels," and adjust the underlying audio processing (e.g., configuration and/or parameters) based on the detected sound objects. Signal chains, select presets, and select parameters of signal processing algorithms can be automatically configured based on the sound object detected. Additionally, the sound object recognition can automatically label the inputs, outputs, and intermediate signals and audio regions in a mixing console, software interface, or through other devices.

The multi-stage method of audio signal analysis, object recognition, and labeling of the presently disclosed invention is followed by mapping of audio-derived metadata features and labels to a sound object-driven multimedia application. This methodology involves separating an audio signal into a plurality of windows and performing a first stage, first pass windowed signal analysis. This first pass analysis may use techniques such as amplitude-detection, fast Fourier transform (FFT), Mel-frequency cepstral coefficients (MFCC), Linear Predictive Coefficients (LPC), wavelet analysis, spectral measures, and stereo/spatial features.

A second pass applies statistical/perceptual/cognitive signal processing and data reduction techniques such as statistical averaging, mean/variance calculation, Gaussian mixture models, principal component analysis (PCA), independent subspace analysis (ISA), hidden Markov models (HMM), pitch-tracking, partial-tracking, onset detection, segmentation, and/or bark/sone mapping.

Still further, a third stage of processing involves machine-learning, data-mining, or artificial intelligence processing such as but not limited to support vector machines (SVN), neural networks (NN), partitioning/clustering, constraint satisfaction, stream labeling, expert systems, classification according to instrument, genre, artist, etc., time-series classification and/or sound object source separation. Optional post processing of the third-stage data may involve time series classification, temporal smoothing, or other meta-classification techniques.

The output of the various processing iterations is mapped into a stream of control events sent to a media-aware software application such as but not limited to content creation and signal processing equipment, software-as-a-service applications, search engine databases, cloud computing, medical devices, or mobile devices.

FIG. 1 illustrates the architecture for an audio metadata engine 100 for audio signal processing and metadata mapping. In FIG. 1, an audio signal source 110 passes input data as a digital signal, which may be a live stream from a microphone or received over network, or a file retrieved from a database or other storage mechanism. The file or stream may be a song, a loop, or a sound track, for example. This input data is used during execution of the signal layer feature extraction module 120 to perform first pass, windowed digital signal analysis routines. The resulting raw feature vector can be stored in a feature database 150.

The signal layer feature-extraction module 120 is executable to read windows of typically between 10 and 100 milliseconds in duration of the input file or stream and calculate some collection of temporal, spectral, and/or wavelet-domain statistical descriptors of the audio source windows. These descriptors are stored in a vector of floating point numbers, the first-pass feature vector, for each incoming audio window.

Some of the statistical features extracted from the audio signal include pitch contour, various onsets, stereo/surround spatial features, mid-side diffusion, and inter-channel spectral differences. Other features include:

- zero crossing rate, which is a count of how many times the signal changes from positive amplitude to negative amplitude during a given period and which correlates to the "noisiness" of the signal;
- spectral centroid, which is the center of gravity of the spectrum, calculated as the mean of the spectral components and is perceptually correlated with the "brightness" and "sharpness" in an audio signal;
- spectral bandwidth, which is the standard deviation of the spectrum, around the spectral centroid, and is calculated as the second standard moment of the spectrum;
- spectral skew, which is the skewness and is a measure of the symmetry of the distribution, and is calculated as the third standard moment of the spectrum;
- spectral kurtosis, which is a measure of the peaked-ness of the signal, and is calculated as the fourth standard moment of the spectrum;
- spectral flatness measure, which quantifies how tone-like a sound is, and is based on the resonant structure and the spiky nature of a tone compared to the flat spectrum of a noise-like sound. Spectral flatness is calculated as the ratio of geometric mean of spectrogram to arithmetic mean of spectrum;
- spectral crest factor is the ratio between the highest peaks and the mean RMS value of the signal and can be used in different frequency bands and quantifies the 'spikiness' of a signal;
- spectral flux, which indicates how much the spectral shape changes from frame to frame;
- spectral flux, which is a measure of how quickly the power spectrum of a signal is changing, calculated by subtracting the power spectrum for one frame against the power spectrum from the previous frame;
- spectral roll-off, which is the frequency in which 85% of the spectrum energy is contained and used to distinguish between harmonic and noisy sounds;
- spectral tilt, which is the slope of least squares linear fit to the log power spectrum;
- log attack time, which measures the period of time it takes for a signal to rise from silence to its maximum amplitude and can be used to distinguish between a sudden and a smooth sound;
- attack slope, which measures the slope of the line fit from the signal rising from silence to its maximum amplitude;
- temporal centroid, which indicates the center of gravity of the signal in time and also indicates the time location where the energy of a signal is concentrated;
- energy in various spectral bands, which is the sum of the squared amplitudes within certain frequency bins; and mel-frequency cepstral coefficients (MFCC), which correlate to perceptually relevant features derived from the Short Time Fourier Transform and are designed to mimic human perception; an embodiment of the present invention may use the accepted standard 12-coefficients, omitting the $0^{th}$ coefficient.

The precise set of features derived in the first-pass of analysis, as well as the various window/hop/transform sizes, is configurable for a given application and likewise adaptable at run-time in response to the input signal.

Whether passed from the signal layer feature extraction module 150 in real-time or retrieved from the feature database 150, the cognitive layer 130 of the audio metadata engine 100 is capable of executing a variety of statistical, perceptual, and audio source object recognition procedures. This layer may perform statistical/perceptual data reduction (pruning) on the feature vector as well as add higher-level metadata such as event or onset locations and statistical moments (derivatives) of features. The resulting data stream is then passed to the symbolic layer module 140 or stored in feature database 150.

With the feature vector extracted for the current audio buffer, the output of the feature extraction module 120 is passed as a vector of real numbers into the cognitive layer module 130. The cognitive layer module 130 is executable to perform second-pass statistical/perceptual/cognitive signal processing and data reduction including, but not limited to statistical averaging, mean/variance calculation, Gaussian mixture models, principal component analysis (PCA), independent subspace analysis (ISA), hidden Markov models, pitch-tracking, partial-tracking, onset detection, segmentation, and/or bark/sone mapping.

Some of the features derived in this pass could be done in the first pass, given a first-pass system with adequate memory, but no look-ahead. Such features might include tempo, spectral flux, and chromagram/key. Other features, such as accurate spectral peak tracking and pitch tracking, are performed in the second pass over the feature data.

Given the series of spectral data for the windows of the source signal, the audio metadata engine 100 can determine the spectral peaks in each window, and extend these peaks between windows to create a "tracked partials" data structure. This data structure may be used to interrelate the harmonic overtone components of the source audio. When such interrelation is achieved, the result is useful for object identification and source separation.

Subject to the data feature vectors for the windows of the source signal, the following processing operations may take place:

Application of perceptual weighting, auditory thresholding and frequency/amplitude scaling (bark, Mel, sone) to the feature data;

Derivation of statistics such as mean, average, and higher-order moments (derivatives) of the individual features as well as histograms and/or Gaussian Mixture Models (GMMs) for raw feature values;

Calculation of the change between MFCCs (known as delta-MFCCs) and change between the delta-MFCCs (known as double-delta MFCCs) of the MFCC coefficients;

Creation of a set of time-stamped event labels using one or many signal onset detectors, silence detectors, segment detectors, and steady-state detectors; a set of time-stamped event labels can correlate to the source signal note-level (or word-level in dialog) behavior for transcribing a simple music loop or indicating the sound object event times in a media file;

Creation of a set of time-stamped events that correlate to the source signal verse/chorus-level behavior using one or more of a set of segmentation modules for music navigation, summarization, or thumb-nailing;

tracking the Pitch/Chromagram/Key features of a musical selection;

generating unique IDs or "finger-prints" for musical selections.

The symbolic layer module 140 is capable of executing any number of machine-learning, data-mining, and/or artificial intelligence methodologies, which suggest a range of run-time data mapping embodiments. The symbolic layer provides labeling, segmentation, and other high-level metadata and clustering/classification information, which may be stored separate from the feature data in a machine-leaning database 160.

The symbolic layer module 140 may include any number of subsidiary modules including clusterers, classifiers, and source separation modules, or use other data-mining, machine-learning, or artificial intelligence techniques. Among the most popular tools are pre-trained support vector machines, neural networks, nearest neighbor models, Gaussian Mixture Models, partitioning clusterers (k-means, CURE, CART), constraint-satisfaction programming (CSP) and rule-based expert systems (CLIPS).

With specific reference to support vector machines, SVMs utilize a non-linear machine classification technique that defines a maximum separating hyperplane between two regions of feature data. A suite of hundreds of classifiers has been used to characterize or identify the presence of a sound object. Said SVMs are trained based on a large corpus of human-annotated training set data. The training sets include positive and negative examples of each type of class. The SVMs were built using a radial basis function kernel. Other kernels, including but not limited to linear, polynomial, sigmoid, or custom-created kernel function can be used depending on the application.

Positive and negative examples as well as two parameters (Cost and Gamma) must be specified in the training set. To find the optimum parameters (Cost and Gamma) of each binary classifier SVM, a traditional grid search was used. Due to the computational burden of this technique on large classifiers, alternative techniques may be more appropriate.

For example, a SVM classifier might be trained to identify snare drums. Traditionally, the output of a SVM is a binary output regarding the membership in a class of data for the input feature vector (e.g., class 1 would be "snare drum" and class 2 would be "not snare drum"). A probabilistic extension to SVMs may be used, which outputs a probability measure of the signal being a snare drum given the input feature vector (e.g., 85% certainty that the input feature vector is class 1—"snare drum").

Using the aforementioned specifically trained SVMs, one approach may involve looking for the highest probability SVM and assign the label of that SVM as being the true label of the audio buffer. Increased performance may be achieved, however, by interpreting the output of the SVMs as a second layer of feature data for the current audio buffer.

One embodiment of the present invention combined the SVMs as using a "template-based approach." This approach uses the outputs of the classifiers as feature data, merging it into the feature vector and then making further classifications based on this data. Many high-level audio classification approaches, such as genre classification, demonstrate improved performance by using a template-based approach. Multi-condition training to improve classifier robustness and accuracy with real-world audio examples may be used.

These statistical/symbolic techniques may be used to add higher-level metadata and/or labels to the source data, such as performing musical genre labeling, content ID finger-printing, or segmentation-based indexing. The symbolic-layer processing module 140 uses the raw feature vector and the second-level features to create song- or sample-specific symbolic (i.e., non-numerical) metadata such as segment points, source/genre/artist labeling, chord/instrument-ID, audio finger-printing, or musical transcription into event onsets and properties.

The final output decision of the machine learning classifier may use a hard-classification from one trained classifier, or use a template-based approach from multiple classifiers. Alternatively, the final output decision may use a probabilistic-inspired approach or leverage the existing tree hierarchy of the classifiers to determine the optimum output. The classification module may be further post-processed by a suite of secondary classifiers or "meta-classifiers." Additionally, the time-series output of the classifiers can be further smoothed and accuracy improved by applying temporal smoothing such as moving average or FIR filtering techniques. A processing module in the symbolic layer may use other methods such as partition-based clustering or use artificial intelligence techniques such as rule-based expert systems to perform the post-processing of the refined feature data.

The symbolic data, feature data, and optionally even the original source stream are then post-processed by applications 180 and their associated processor scripts 170, which map the audio-derived data to the operation of a multimedia software application, musical instrument, studio, stage or broadcast device, software-as-a-service application, search engine database, or mobile device as examples.

Such an application, in the context of the presently disclosed invention, includes a software program that implements the multi-stage signal analysis, object-identification and labeling method, and then maps the output of the symbolic layer to the processing of other multimedia data.

Applications may be written directly in a standard application development language such as C++, or in scripting languages such as Python, Ruby, JavaScript, and Smalltalk. In one embodiment, support libraries may be provided to software developers that include object modules that carry out the method of the presently disclosed invention (e.g., a set of software class libraries for performing the multi-stage analysis, labeling, and application mapping).

Offline or "non-real-time" approaches allow a system to analyze and individually labels all audio frames, then making a final mapping of the audio frame labels. Real-time systems do not have the advantage of analyzing the entire audio file—they must make decisions each audio buffer. They can, however, pass along history of frame and buffer label data.

For on-the-fly machine learning algorithms, the user will typically allow the system to listen to only a few examples or segments of audio material, which can be triggered by software or hardware. In one embodiment of the invention, the application processing scripts receive the probabilistic outputs from SVMs as its input. The modules then select the SVM with the highest likelihood of occurrence and outputs the label of that SVM as the final label.

For example, a vector of numbers corresponding to the label or set of labels may be output, as well as any relevant feature extraction data for the desired application. Examples would include passing the label vector to an external audio effects algorithm, mixing console, or audio editing software; whereby, those external applications would decide which presets to select in the algorithm or how their respective user interfaces would present the label data to the user. The output may, however, simply be passed as a single label.

The feature extraction, post-processing, symbolic layer and application modules are, in one embodiment, continuously run in real-time. In another embodiment, labels are only output when a certain mode is entered, such as a "listen mode" that would could trigger on a live sound console, or "label-my-tracks-now mode" in a software program. Applications and processing scripts determine the configuration of the three layers of processing and their use in the run-time processing and control flow of the supported multimedia software or device. A stand-alone data analysis and labeling run-time tool that populates feature and label databases is envisioned as an alternative embodiment of an application of the presently disclosed invention.

Figure 2:
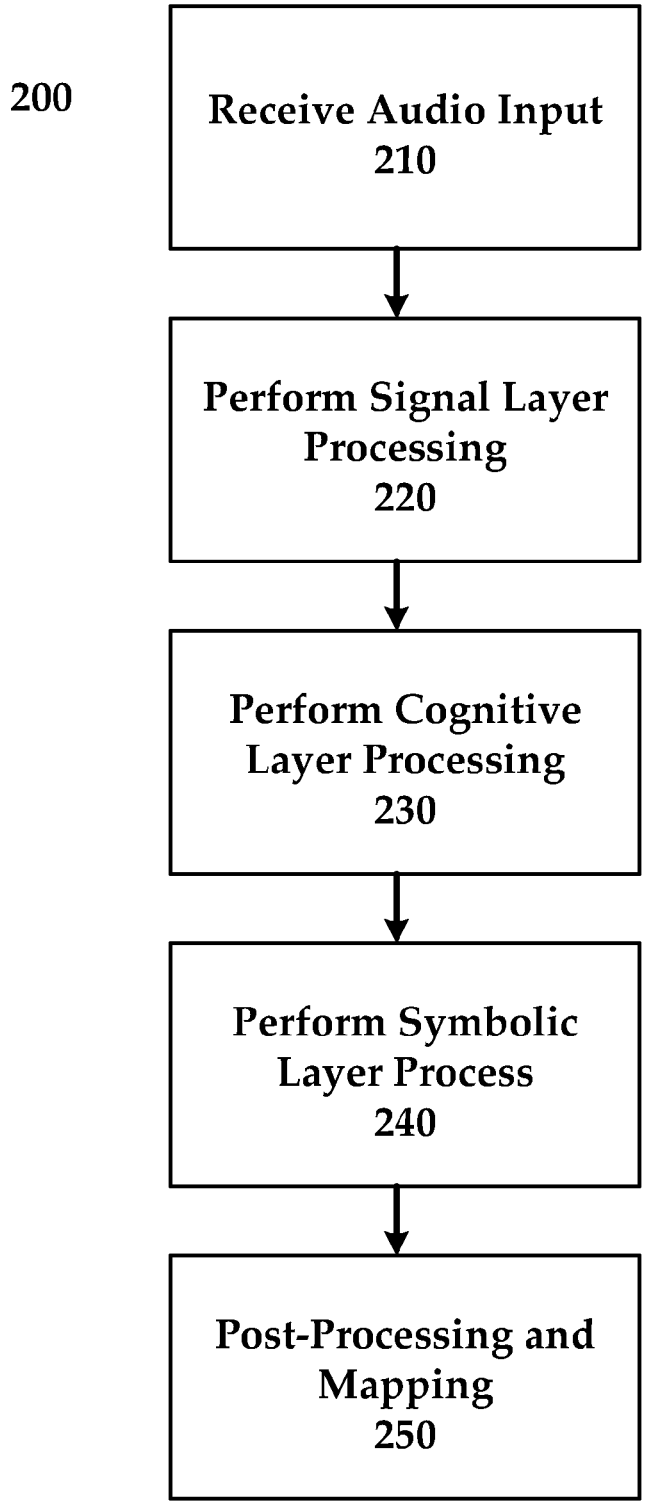
FIG. 2 illustrates a method for processing of audio signals and mapping of metadata.

FIG. 2 illustrates a method 200 for processing of audio signals and mapping of metadata. Various combinations of hardware, software, and computer-executable instructions (e.g., program modules and engines) may be utilized with regard to the method of FIG. 2. Program modules and engines include routines, programs, objects, components, data structures, and the like that perform particular tasks or implement particular abstract data types. Computer-executable instructions and associated data structures represent examples of the programming means for executing steps of the methods and doing so within the context of the architecture illustrated n FIG. 1, which may be implemented in the hardware environment of FIG. 3.

In step 210, audio input is received. This input might correspond to a song, loop or sound track. The input may be live or streamed from a source; the input may also be stored in memory. At step 220, signal layer processing is performed, which may involve feature extraction to derive a raw feature vector. At step 230, cognitive layer processing occurs and which may involve statistical or perceptual mapping, data reduction, and object identification. This operation derives, from the raw feature vector, a reduced and/or improved feature vector. Symbolic layer processing occurs at step 240 involving the likes of machine-learning, data-mining, and application of various artificial intelligence methodologies. As a result of this operation on the reduced and/or improved feature vector derived in the process of step 240, one or more sound object labels are generated that refer to the original audio signal. Post-processing and mapping occurs as step 250 whereby applications may be configured responsive to the output of the aforementioned processing steps (e.g., the sound object labels into a stream of control events sent to a sound-object-driven multimedia-aware software application).

Following steps 220, 230, and 240, the results of each processing step may be stored in a database. Similarly, prior to the execution of steps 220, 230, and 240, previously processed or intermediately processed data may be retrieved from a database. The post-processing operations of step 250 may involve retrieval of processed data from the database and application of any number of processing scripts, which may likewise be stored in memory or accessed and executed from another application, which may be accessed from a removable storage medium such as a CD or memory card as illustrated in FIG. 3.

Figure 3:
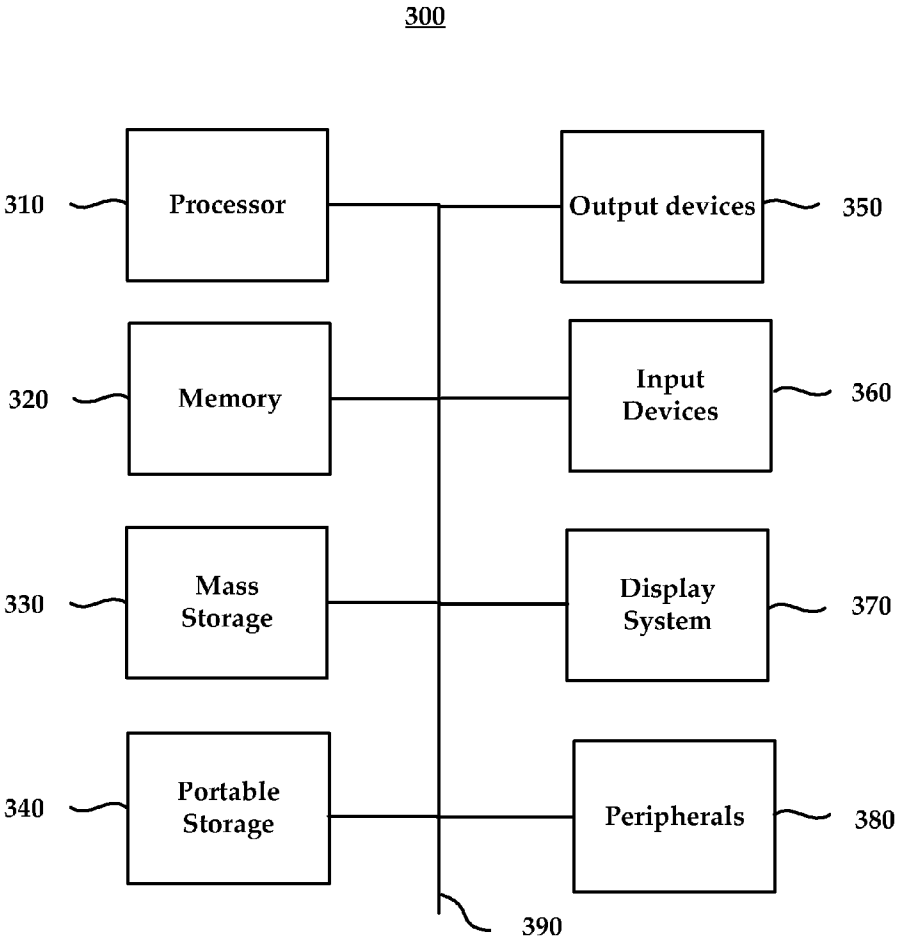
FIG. 3 illustrates an exemplary computing device that may implement an embodiment of the present invention.

FIG. 3 illustrates an exemplary computing device 300 that may implement an embodiment of the present invention, including the system architecture of FIG. 1 and the methodology of FIG. 2. The components contained in the device 300 of FIG. 3 are those typically found in computing systems that may be suitable for use with embodiments of the present invention and are intended to represent a broad category of such computing components that are well known in the art.

Thus, the device 300 of FIG. 3 can be a personal computer, hand-held computing device, telephone, mobile computing device, workstation, server, minicomputer, mainframe computer, or any other computing device. The device 300 may also be representative of more specialized computing devices such as those that might be integrated with a mixing and editing system.

The computing device 300 of FIG. 3 includes one or more processors 310 and main memory 320. Main memory 320 stores, in part, instructions and data for execution by processor 310. Main memory 320 can store the executable code when in operation. The device 300 of FIG. 3 further includes a mass storage device 330, portable storage medium drive(s) 340, output devices 350, user input devices 360, a graphics display 370, and peripheral devices 380.

The components shown in FIG. 3 are depicted as being connected via a single bus 390. The components may be connected through one or more data transport means. The processor unit 310 and the main memory 320 may be connected via a local microprocessor bus, and the mass storage device 330, peripheral device(s) 380, portable storage device 340, and display system 370 may be connected via one or more input/output (I/O) buses. Device 900 can also include different bus configurations, networked platforms, multi-processor platforms, etc. Various operating systems can be used including Unix, Linux, Windows, Macintosh OS, Palm OS, webOS, Android, iPhone OS, and other suitable operating systems Mass storage device 330, which may be implemented with a magnetic disk drive or an optical disk drive, is a non-volatile storage device for storing data and instructions for use by processor unit 310. Mass storage device 330 can store the system software for implementing embodiments of the present invention for purposes of loading that software into main memory 320.

Portable storage device 340 operates in conjunction with a portable non-volatile storage medium, such as a floppy disk, compact disk, digital video disc, or USB storage device, to input and output data and code to and from the device 300 of FIG. 3. The system software for implementing embodiments of the present invention may be stored on such a portable medium and input to the device 300 via the portable storage device 340.

Input devices 360 provide a portion of a user interface. Input devices 360 may include an alpha-numeric keypad, such as a keyboard, for inputting alpha-numeric and other information, or a pointing device, such as a mouse, a trackball, stylus, or cursor direction keys. Additionally, the device 300 as shown in FIG. 3 includes output devices 350. Suitable output devices include speakers, printers, network interfaces, and monitors.

Display system 370 may include a liquid crystal display (LCD) or other suitable display device. Display system 370 receives textual and graphical information, and processes the information for output to the display device.

Peripherals 380 may include any type of computer support device to add additional functionality to the computer system. Peripheral device(s) 380 may include a modem, a router, a camera, or a microphone. Peripheral device(s) 380 can be integral or communicatively coupled with the device 300.

Any hardware platform suitable for performing the processing described herein is suitable for use with the technology. Non-transitory computer-readable storage media refer to any medium or media that participate in providing instructions to a central processing unit (CPU), a processor, a microcontroller, or the like. Such media can take forms including, but not limited to, non-volatile and volatile media such as optical or magnetic disks and dynamic memory, respectively. Common forms of non-transitory computer-readable storage media include a floppy disk, a flexible disk, a hard disk, magnetic tape, any other magnetic storage medium, a CD-ROM disk, digital video disk (DVD), any other optical storage medium, RAM, PROM, EPROM, a FLASHEPROM, any other memory chip or cartridge.

With the foregoing principles of operation in mind, the presently disclosed invention may be implemented in any number of modes of operation, an exemplary selection of which are discussed in further detail here. While various embodiments have been described above and are discussed as follows, it should be understood that they have been presented by way of example only, and not limitation. The descriptions are not intended to limit the scope of the technology to the particular forms set forth herein.

The present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

Recording/Mixing

The process of audio recording and mixing is a highly-manual process, despite being a computer-oriented process. To start a recording or mixing session, an audio engineer attaches microphones to the input of a recording interface or console. Each microphone corresponds to a particular instrument to be recorded. The engineer usually prepares a cryptic "cheat sheet" listing which microphone is going to which channel on the recording interface, so that they can label the instrument name on their mixing console. Alternatively, if the audio is being routed to a digital mixing console or computer recording software, the user manually types in the instrument name of audio track (e.g., "electric guitar").

Based on the instrument to be recorded or mixed, a recording engineer almost universally adds traditional audio signal processing tools, such as compressors, gates, limiters, equalizers, or reverbs to the target channel. The selection of which audio signal processing tools to use in a track's signal chain is commonly dependent on the type of instrument; for example, an engineer might commonly use an equalizer made by Company A and a compressor made by Company B to process their bass guitar tracks. Whereas, if the instrument being recorded or mixed is a lead vocal track, the engineer might then use a signal chain including a different equalizer by Company C, a limiter by Company D, pitch correction by Company E, and setup a parallel signal chain to add in a some reverb from an effects plug-in made by Company F. Again, these different signal chains and choices are often a function of the tracks' instruments.

If an audio processing algorithm knows what it is listening to, it can more intelligently adapt its processing and transformations of that signal towards the unique characteristics of that sound. This is a natural and logical direction for all traditional audio signal processing tools. In one application of the presently disclosed invention, the selection of the signal processing tools and setup of the signal chain can be completely automated. The sound object recognition system would determine what the input instrument track is and inform the mixing/recording software—the software would then load the appropriate signal chain, tools, or stored behaviors for that particular instrument based on a simple table-look-up, or a sophisticated rule-based expert system.

In addition to the signal chain and selection of the signal processing tools, the selection of the presets, parameters, or settings for those signal processing tools is highly dependent upon the type of instrument to be manipulated. Often, the audio parameters to control the audio processing algorithm are encoded in "presets." Presets are predetermined settings, rules, or heuristics that are chosen to best modify a given sound.

An example preset would be the settings of the frequency weights of an equalizer, or the ratio, attack, and release times for a compressor; optimal settings for these parameters for a vocal track would be different than the optimal parameters for a snare drum track. The presets of an audio processing algorithm can be automatically selected based upon the instrument detected by the sound object recognition system. This allows for the automatic selection of presets for hardware and software implementations of EQs, compressors, reverbs, limiters, gates, and other traditional audio signal processing tools based on the current input instrument—thereby greatly assisting and automating the role of the recording and mixing engineers.

Mixing Console Embodiment

Implementation may likewise occur in the context of hardware mixing consoles and routing systems, live sound systems, installed sound systems, recording and production studios systems, and broadcast facilities as well as software-only or hybrid software/hardware mixing consoles. The presently disclosed invention further elicits a certain degree of robustness against background noise, reverb, and audible mixtures of other sound objects. Additionally, the presently disclosed invention can be used in real-time to continuously listen to the input of a signal processing algorithm and automatically adjust the internal signal processing parameters based on sound detected.

Audio Compression

The presently disclosed invention can be used to automatically adjust the encoding or decoding settings of bit-rate reduction and audio compression technologies, such as Dolby Digital or DTS compression technologies. Sound object recognition techniques can determine the type of audio source material playing (e.g., TV show, sporting event, comedy, documentary, classical music, rock music) and pass the label onto the compression technology. The compression encoder/decoder then selects the best codec or compression for that audio source. Such an implementation has wide applications for broadcast and encoding/decoding of television, movie, and online video content.

Live Sound

Robust real-time sound object recognition and analysis is an essential step forward for autonomous live sound mixing systems. Audio channels that are knowledgeable about their tracks contents can silence expected noises and content, enhance based on pre-determined instrument-specific heuristics, or make processing decisions depending on the current input. Live sound and installed sound installations can leverage microphones which intelligently turn off the desired instrument or vocalist is not playing into them—thereby gating or lowering the volume of other instruments' leakage, preventing feedback, background noise, or other signals from being picked up.

A "noise gate" or "gate" is a widely-used algorithm which only allows a signal to pass if its amplitude exceeds a certain threshold. Otherwise, no sound is output. The gate can be implemented either as an electronic device, host software, or embedded DSP software, to control the volume of an audio signal. The user of the gate sets a threshold of the gate algorithm. The gate is "open" if the signal level is above the threshold—allowing the input signal to pass through unmodified. If signal level is below the threshold, the gate is "closed"—causing the input signal to be attenuated or silenced altogether.

Using an embodiment of the presently disclosed invention, one could vastly improve a gate algorithm to use instrument recognition to control the gate—rather than the relatively naïve amplitude parameter. For example, a user could allow the gate on their snare drum track to allow "snare drums only" to pass through it—any other detected sounds would not pass. Alternatively, one could simultaneously employ sound object recognition and traditional amplitude-threshold detection to open the gate only for snare drums sounds above a certain amplitude threshold. This technique combines the most desirable aspects of both designs.

Alternatively, the presently disclosed invention may use multiple sound objects as a means of control for the gate; for example, a gate algorithm could open if "vocals or harmonica" were present in the audio signal. As another application, a live sound engineer could configure a "vocal-sensitive gate" and select "male and female vocals only" on their microphone, microphone pre-amp, or noise gate algorithm. This setting would prevent feedback from occurring on other speakers—as the sound object identification algorithm (in this case, the sound object detected is a specific musical instrument) would not allow a non-vocal signal to pass. Since other on-stage instruments are frequently louder than the lead vocalist, the capability to not have a level-dependent microphone or gate, but rather a "sound object aware gate", makes this technique a great leap forward in the field of audio mixing and production.

The presently disclosed invention is by no means limited to a gate algorithm, but could offer similar control of software or hardware implementations of audio signal processing functions, including but not limited to equalizers, compressors, limiters, feedback eliminators, distortion, pitch correction, and reverbs. The presently disclosed invention could, for example, be used to control guitar amplifier distortion and effects processing. The output sound quality and tone of these algorithms, used in guitar amplifiers, audio software plug-ins, and audio effects boxes, is largely dependent on the type of guitar (acoustic, electric, bass, etc), body type (hollow, solid body, etc), pick-up type (single coil, humbucker, piezoelectric, etc), location (bridge, neck), among other parameters. This invention can label guitar sounds based on these parameters, distinguishing the sound of hollow body versus solid body guitars, types of guitars, etc. The sound object labels characterizing the guitar can be passed into the guitar amplifier distortion and effects units to automatically select the best series of guitar presets or effects parameters based on a user's unique configuration of guitar.

Sound-Object

Embodiments of the presently disclosed invention may automatically generate labels for the input channels, output channels, and intermediary channels of the signal chain. Based on these labels, an audio engineer can easily navigate around a complex project, aided by the semantic metadata describing the contents of a given track. Automatic description of the contents of each track not only saves countless hours of monotonous listening and hand-annotations, but aids in preventing errors from occurring during critical moments of a session. These labels can be used on platforms including but not limited to hardware-based mixing consoles or software-based content-creation software. As a specific example, we can label intermediate channels (or busses) in real-time, which are frequently not labeled by audio engineers or left with cryptic labels such as "bus 1." Changing the volume, soloing, or muting a channel with a confusing track name and unknown content are frequent mistakes of both novice and professional audio engineers. Our labels ensure that the audio engineer always knows actual audio content of each track at any given time.

Users of digital audio and video editing software face similar hurdles to live sound engineers—the typical software user interface can show dozens of seemingly identical playlists or channel strips. Each audio playlist or track is manually given a unique name, typically describing the instrument that is on that track. If the user does not name the track, the default names are non-descriptive: "Audio1", "Audio2", etc.

Labels can be automatically generated to track names of audio regions in audio/video editing software. This greatly aids the user in identifying the true contents of each track, and facilitates rapid, error-free, workflows. Additionally, the playlists/tracks on digital audio and video editing software contain multiple regions per audio track—ranging from a few to several hundred regions. Each of these regions refers to a discrete sound file or an excerpt of a sound file. An implementation of the present invention would provide analysis of the individual regions and provide an automatically-generated label for each region on a track—allowing the user to instantly identify the contents of the region. This would, for example, allow the user to rapidly identify which regions are male vocals, which regions are electric guitars, etc. Such techniques will greatly increase the speed and ease in which a user can navigate their sessions. Labeling of regions could be textual, graphical (icons corresponding to instruments), or color-coded.

Using an embodiment of the presently disclosed invention, waveforms (a visualization which graphically represents the amplitude of a sound file over time) can be drawn to more clearly indicate the content of the track. For example, the waveform could be modified to show when perceptually-meaningful changes occur (e.g., where speaker changes occur, where a whistle is blown in a game, when the vocalist is singing, when the bass guitar is playing). Additionally, acoustic visualizations are useful for disc jockeys (DJs) who need to visualize the songs that they are about to cue and play. Using the invention, the sound objects in the song file can be visualized; sound-label descriptions of where the kick drums and snare drums are in the song, and also where certain instruments are present in a song. (e.g., Where do the vocals occur? Where is the lead guitar solo?) A visualization of the sound objects present in the song would allow a disc jockey to readily navigate to the desired parts of the song without having to listen to the song.

Semantic Analysis of Media Files

Embodiments of the presently disclosed invention may be implemented to analyze and assign labels to large libraries of pre-recorded audio files. Labels can be automatically generated and embedded into the metadata of audio files on a user's hard drive, for easier browsing or retrieval. This capability would allow navigation of a personal media collection by specifying what label of content a user would like to see: such as "show me only music tracks" or "show me on female speech tracks." This metadata can be included into $3^{rd}$ party content-recommendation solutions, to enhance existing recommendations on user preferences.

Labels can be automatically generated and applied to audio files recorded by a field recording device. As a specific example, many mobile phones feature a voice recording application. Similarly, musicians, journalists, and recordists use handheld field recorders/digital recorders to record musical ideas, interviews, and every day sounds. Currently, the files generated by the voice memo software and handheld recorders include only limited metadata, such as the time and date of the recording. The filenames generated by the devices are cryptic and ambiguous regarding the actual content of the audio file. (e.g., "Recording 1", "Recording 2", or "audio file1.wav").

File names, through implementation of the presently disclosed invention, may include an automatically generated label describing the audio contents—creating filenames such as "Acoustic Guitar", "Male speech", or "Bass Guitar." This allow for easy retrieval and navigation of the files on a mobile device. Additionally, the labels can be embedded in the files as part of the metadata to aid in search and retrieval of the audio files. The user could also train a system to recognize their own voice signature or other unique classes, and have files labeled with this information. The labels can be embedded, on-the-fly as discrete sound object events into the field recorded files—so as to aid in future navigation of that file or metadata search.

Another application of the presently disclosed invention concerns analysis of the audio content of video tracks or video streams. The information that is extracted can be used to summarize and assist in characterizing the content of the video files. For example, we can recognize the presence of real-world sound objects in video files. Our metadata includes, but is not limited to, a percentage measurement of how much of each sound object is in program. For example, we might calculate that a particular video file contain "1% gun shots", "50% adult male speaking/dialog" and 20% music. We would also calculate a measure of the average loudness of the each of the sound object in the program.

Examples sound objects include, but are not limited to: music, dialog (speech), silence, speech plus music (simultaneous), speech plus environmental (simultaneous), environment/low-level background (not silence), ambience/atmosphere (city sounds, restaurant, bar, walla), explosions, gun shots, crashes and impacts, applause, cheering crowd, and laughter. The present invention includes hundreds of machine-learning trained sound objects, representing a vast cross-section of real-world sounds.

The information concerning the quantity, loudness, and confidence of each sound object detected could be stored as metadata in the media file, in external metadata document formats such as XMP, JSON, or XML, or added to a database. The sound objects extracted from metadata can be further grouped together to determine higher-level concepts. For example, we can calculate a "violence ratio" which measures the number of gun shots and explosions in a particular TV show compared to standard TV programming.

Other higher-level concepts which could characterize media files include but are not limited to: a "live audience measure", which is a summary of applause plus cheering crowd plus laugh tracks in a media file; a "live concert measure," which is determined by looking at the percentage of music, dialog, silence, applause, and cheering crowd; and an "excitement measure" which measures the amount of cheering crowds and loud volume levels in the media file.

These sound objects extracted from media files can be used in a system to search for similar-sounding content. The descriptors can be embedded as metadata into the videos files, stored in a database for searching and recommendation, transmitted to a third-party for further review, sent to a downstream post-processing path, etc. The example output of this invention could also be a metadata representation, stored in text files, XML, XMP, or databases, of how much of each "sound object" is within a given video file.

A sound-similarity search engine can be constructed by indexing a collection of media files and storing the output of several of the stages produced by the invention (including but not limited to the sound object recognition labels) in a database. This database can be searched based on searching for similar sound object labels. The search engine and database could be used to find sounds that sound similar to an input seed file. This can be done by calculating the distance between a vector of sound object labels of the input seed to vectors of sound object labels in the database. The closest matches are the files with the least distance.

The presently disclosed invention can be used to automatically generate labels for user-generated media content. Users contribute millions of audio and video files to sites such as YouTube and Facebook; the user-contributed metadata for those files is often missing, inaccurate, or purposely misleading. The sound object recognition labels could can automatically added to the user-generated content and greatly aid in the filtering, discovery, and recommendation of new content.

The presently disclosed invention can be used to generate labels for large archives of unlabeled material. Many repositories of audio content, such as the Internet Archive's collection of audio recordings, could be searched by having the acoustic content and labels of the tracks automatically added as metadata. In the context of broadcasting, the presently disclosed invention can be used to generate real-time, on-the-fly segmentation or markers of events. We can analyze the audio stream of a live or recorded television broadcast and label/identify "relevant" audio events. With this capability, one can seek, rewind, or fast-forward, to relevant audio events in a timeline—such as skipping between baseball at-bats in a recorded baseball game by jumping to the time-based labels of the sound of bat hitting a ball, or periods of intense crowd noise. Similarly other sports could be segmented by our sound object recognition labels by seeking between periods of the video where the referee's whistle blows. This adds advanced capabilities not reliant upon manual indexing or faulty video image segmentation.

Mobile Devices and Smart Phones

The automatic label detection and sound object recognition capabilities of the presently disclosed invention could be used to add additional intelligence to mobile devices, including but not limited to mobile cell phones and smart phones. Embodiments of the present invention can be run as a foreground application on the smart phone or as a background detection application for determining the surrounding sound objects and acoustic environment that the phone is in, via analyzing audio from the phone's microphone as a real-time stream, and determining sound object labels such as atmosphere, background noise level, presence of music, speech, etc.

Certain actions can be programmed for the mobile device based on acoustic environmental detection. For example, the invention could be used to create situation-specific ringtones, whereby a ringtone is selected based on background noise level or ambient environment (e.g., if you are at a rock concert, then turn vibrate on, if you are at a baseball game, make sure the ringer and vibrate are also on.)

Mobile phones using an implementation of this invention can provide users with information about what sounds they were exposed to in a given day (e.g., how much music you listened to per day, how many different people you talked to you during the day, how long you personally spent talking, how many loud noises were heard, number of sirens detected, dog barks, etc.). This information could be posted as a summary about the owner's listening habits on a web site or to social networking sites such as MySpace and Facebook. Additionally, the phone could be programmed to instantly broadcast text messages or "tweets" (via Twitter) when certain sounds (e.g., dog bark, alarm sound) were detected.

This information may be of particular interest for targeted advertising. For example, if the cry of a baby is detected, then advertisements concerning baby products may be of interest to the user. Similarly, if the sounds of sporting events are consistently detected, advertisements regarding sporting supplies or sporting events may be appropriately directed at the user.

Medical Applications

Embodiments of the present invention may be used to aid numerous medical applications, by listening to the patient and determining information such as cough detection, cough count frequency, and respiratory monitoring. This is useful for allergy, health & wellness monitoring, or monitoring efficacy of respiratory-aiding drugs. Similarly, the invention can provide sneeze detection, sneeze count frequency, and snoring detection/sleep apnea sound detection.

What is claimed is:

1. A non-transitory computer-readable storage medium having embodied thereon a program, the program being executable by a processor to perform a method for multi-stage audio signal analysis, the method comprising:

performing a first-stage processing operation on an audio signal, the first stage processing operation including a windowed signal analysis to calculate from the audio signal statistical descriptor features that are stored in a raw feature vector;

performing a second stage statistical processing operation on the raw feature vector to derive a reduced feature vector;

performing a third stage processing operation on the reduced feature vector to derive at least one sound object label that refers to the original audio signal; and mapping the at least one sound object label into a stream of control events sent to a sound-object-driven, multimedia-aware software application, wherein the sound-object-driven multimedia-aware software application is responsive to the stream of control events to configure processing for the audio signal, and wherein any of the processing operations of the first through third stages are configurable.

2. The non-transitory computer-readable storage medium of claim 1, wherein the audio signal is a file, and the method further comprises retrieving the file from a storage device.

3. The non-transitory computer-readable storage medium of claim 1, wherein the audio signal is a stream, and the method further comprises receiving the stream as a digital signal from an input device or a network connection.

4. The non-transitory computer-readable storage medium of claim 1, wherein the first stage processing operation is selected from the group consisting of amplitude-detection, FFT, MFCC, LPC, wavelet analysis, spectral measures, and stereo/spatial feature extraction.

5. The non-transitory computer-readable storage medium of claim 1, wherein the second stage processing operation is selected from the group consisting of statistical averaging, mean/variance calculation, statistical moments, Gaussian mixture models, principal component analysis (PCA), independent subspace analysis (ISA), hidden Markhov models, tempo-tracking, pitch-tracking, peak/partial-tracking, onset detection, segmentation, and bark/sone mapping.

6. The non-transitory computer-readable storage medium of claim 1, wherein the third stage processing operation is selected from the group consisting of support vector machines (SVN), neural networks (NN), partitioning/clustering, constraint satisfaction, stream labeling, rule-based expert systems, classification according to instrument, genre, or artist, musical transcription, and/or and sound object source separation.

7. The non-transitory computer-readable storage medium of claim 2 or 3, wherein the audio signal is selected from the group consisting of a song, music loop, music clips, sound track, sound effects, and audio signals, and wherein the windowed signal analysis is performed on the audio signal.

8. The non-transitory computer-readable storage medium of claim 1, wherein any of the first through third stages are stored in a database and may be retrieved for use in a subsequent analytical operation.

9. The non-transitory computer-readable storage medium of claim 1, wherein the first through fourth stages are all processed in real-time for use in an on-the-fly analytical operation.

10. The non-transitory computer-readable storage medium of claim 1, wherein the sound-object-driven, multimedia-aware software application is a mixing/recording application, and the sound object label automates the selection of signal processing tools and the setup of a signal chain in the mixing/recording application.

11. The non-transitory computer-readable storage medium of claim 10, wherein the automation of the signal processing tools and the setup of a signal chain includes the use of a look-up table.

12. The non-transitory computer-readable storage medium of claim 10, wherein the automation of the signal processing tools and the setup of a signal chain includes the use of one or more rules.

13. The non-transitory computer-readable storage medium of claim 1, wherein the sound-object-driven, multimedia-aware software application is a mixing/recording application, and the sound object label automates the selection of an audio parameter encoded in a preset of the mixing/recording application.

14. The non-transitory computer-readable storage medium of claim 1, wherein the sound-object-driven, multimedia-aware software application adjusts in real-time an internal signal processing parameter of a mixing console in response to the at least one sound object label.

15. The non-transitory computer-readable storage medium of claim 1, wherein the sound-object-driven, multimedia-aware software application is executable to select a codec in response to the type of audio source associated with the audio signal.

16. The non-transitory computer-readable storage medium of claim 1, wherein the sound-object-driven, multimedia-aware software application is executable to allow processing of the audio signal when the audio signal corresponds to a particular sound type.

17. The non-transitory computer-readable storage medium of claim 16, wherein the sound-object-driven, multimedia-aware software application is executable to allow processing of the audio signal when the particular sound type exceeds a particular amplitude.

18. The non-transitory computer-readable storage medium of claim 1, wherein the sound-object-driven, multimedia-aware software application is executable to allow processing of the audio signal when the audio signal exhibits a particular characteristic selected from the group consisting of feedback, distortion, pitch, and reverb.

19. The non-transitory computer-readable storage medium of claim 1, wherein the sound-object-driven, multimedia-aware software application is executable to apply a descriptive label associated with semantic data derived from the audio signal.

20. The non-transitory computer-readable storage medium of claim 1, wherein the sound-object-driven, multimedia-aware software application is executable to identify an environment surrounding a source of the audio signal.

21. The non-transitory computer-readable storage medium of claim 20, wherein a functionality of a mobile device is configured in response to identification of the environment.

22. The non-transitory computer-readable storage medium of claim 21, wherein the functionality of the mobile device includes the selection and volume of a ring tone.

23. The non-transitory computer readable storage medium of claim 1, wherein the method is executable to identify a medically-relevant characteristic of the audio signal.

24. A method comprising:

performing a first-stage processing operation on an audio signal, the first stage processing operation including a windowed signal analysis that derives a raw feature vector;

performing a second stage statistical processing operation on the raw feature vector to derive a reduced feature vector;

performing a third stage processing operation on the reduced feature vector to derive at least one sound object label that refers to the original audio signal; and mapping the at least one sound object label into a stream of control events sent to a sound-object-driven, multimedia-aware software application, wherein the sound-object-driven multimedia-aware software application is responsive to the stream of control events to configure processing for the audio signal, and wherein any of the processing operations of the first through third stages are configurable.

25. The method claim 24, wherein the first through fourth stages are all processed in real-time for use in an on-the-fly analytical operation.

26. The method 24, wherein the sound-object-driven, multimedia-aware software application is a mixing/recording application, and the sound object label automates the selection of signal processing tools and the setup of a signal chain in the mixing/recording application.

27. The method of claim 24, wherein the sound-object-driven, multimedia-aware software application adjusts in real-time an internal signal processing parameter of a mixing console in response to the at least one sound object label.

28. The method claim 24, wherein the sound-object-driven, multimedia-aware software application is executable to select a codec in response to the type of audio source associated with the audio signal.

29. The method of claim 24, wherein the method is executable to identify an environment surrounding a source of the audio signal, and a functionality of a mobile device is configured in response to identification of the environment.

30. The method of claim 24, wherein the sound-object-driven, multimedia-aware software application is executable in real-time to adjust an internal signal processing parameter of a mixing console in response to the audio sign al.

31. A method comprising:

performing a first-stage processing operation on an audio signal, the first stage processing operation including a windowed signal analysis that derives a raw feature vector;

performing a second stage statistical processing operation on the raw feature vector to derive a reduced feature vector;

performing a third stage processing operation on the reduced feature vector to derive at least one sound object label that refers to the original audio signal; and mapping the at least one sound object label into a stream of control events sent to a sound-object-driven, multimedia-aware software application, wherein sound-object-driven, multimedia-aware software application adjusts an internal signal processing parameter of a mixing console in response to the at least one sound object label.

* * * * *